US005636661A

United States Patent [19]

Moyes

[11] Patent Number: 5,636,661

[45] Date of Patent: Jun. 10, 1997

[54] SELF-PILOTING CHECK VALVE

[75] Inventor: Peter B. Moyes, Durno, United Kingdom

[73] Assignee: Petroline Wireline Services Limited, Scotland, United Kingdom

[21] Appl. No.: 564,399

[22] Filed: Nov. 29, 1995

[30] Foreign Application Priority Data

Nov. 30, 1994 [GB] United Kingdom ..... 9424226

[51] Int. Cl.[6] ..... F16K 15/03; F16K 15/18

[52] U.S. Cl. ..... 137/614.2; 137/496; 166/325; 166/332.4; 166/332.8

[58] Field of Search ..... 137/496, 614.2; 166/325, 332.4, 332.8

[56] References Cited

U.S. PATENT DOCUMENTS 4,220,176 9/1980 Russell .

4,254,836 3/1981 Russell .

*Primary Examiner*—Gerald A. Michalsky

*Attorney, Agent, or Firm*—Bell, Seltzer, Park & Gibson, P.A.

[57] ABSTRACT

A check valve 200 has an elongate cylindrical tubular body 202 which provides mounting for a main flap valve 204. Mounted below the main valve 204 is a smaller multi-leaf flap valve 206. The smaller valve 206 is mounted on a housing 208 which is axially movable relative to the body 202. The housing 208 and valve 206 are normally biased upwardly and in this position a sleeve 214 formed on the upper end of the housing holds the main valve 204 open, and encloses the valve 204 within a valve recess 216 defined in the body 202. The sleeve 214 also extends across the main valve seat 218. Thus, during normal operation of the valve, with flow in a first direction, the sealing surfaces of the main valve 204 and the seat 218 are protected from the fluid by the sleeve 214.

10 Claims, 11 Drawing Sheets

SURFING

LOCKED OPEN

NORMALLY CLOSED

SELF-PILOTING CHECK VALVE

FIELD OF THE INVENTION

This invention relates to an improved valve, and in particular but not exclusively to improvements in and relating to self-piloting check valve. The invention also relates to various detail features which may be incorporated in such a valve, or in other tools or apparatus.

BACKGROUND OF THE INVENTION

Proposals have been made for self-piloting check valve apparatus, in which dual valves are provided. One valve serves as a pilot valve, such as a spring-biased check valve, closing of which permits closing of a main valve, such as a ball valve, adapted to withstand elevated pressures. When fluid is flowing in the permitted direction the flow of fluid holds the check valve open and a spring biases the main valve to the open position. If there is no fluid flow the check valve closes, while the main valve remains open. If there should be a tendency for fluid to flow in the non-permitted direction, the pressure forces acting on the closed check valve are utilised to move the main valve to the closed position. Such valves have application in many situations.

The present invention will be described with reference to downhole uses in the oil and gas exploration and extraction industries, though the invention may of course be utilised in many other industries.

SUMMARY OF THE INVENTION

According to a first aspect of the present invention there is provided a check valve for location in a bore having fluid flowing therethrough, the valve comprising a plurality of valve members, the surfaces of which are profiled to conform with the bore profile when the valve members are in the open position.

In use, the valve members will thus ride or surf on the fluid flowing through the valve, in contrast to conventional check valves in which the sharp-edged valve members tend to intrude into the bore and thus interfere with the flow. Such interference increases the pressure drop across the valve and may also induce high frequency vibration, which can lead to premature failure of springs utilised to bias the valve members to the closed position.

According to a second aspect of the present invention there is provided valve apparatus for permitting flow in a first direction and preventing flow in a second direction, the apparatus comprising a body defining a through bore, a normally closed first valve, a normally open main ball valve mounted within the body and rotatable relative to the body between an open position and a closed position, means for producing rotation of the ball in the event of relative axial movement of the ball and body, a ball pusher axially movable in the body and having a portion in contact with the ball, and means for biassing the ball to the open position, wherein closure of the first valve, in the event of a tendency for fluid to flow in the second direction, produces a pressure force on the first valve which is directed to move the main valve to the closed position, characterised in that the end of the ball pusher is formed of a low-friction material.

The ball pusher may be utilised to push the main valve open or closed. Alternatively, two ball pushers may be provided, one on either side of the valve.

In larger valves the friction between the ball pusher and the main valve may be significant, considerably increasing the force that must be applied to the pusher in order to open or close the valve. The provision of a low-friction material at the end of the ball-pusher considerably reduces the force necessary to operate the valve.

A third aspect of the invention is characterised by a damping arrangement in which a member forming part of or connected to the ball pusher and a part of the body define a chamber and a chamber opening, the surfaces of the member and the part of the body being arranged such that the chamber opening is relatively large over an initial degree of movement between the member and part and is then reduced following said initial movement to restrict the flow of fluid from the chamber.

In use, the initial movement of the member relative to the body is thus undamped or only lightly damped, permitting relatively rapid initial movement of the ball pusher and the ball, whereas subsequent movement is more heavily damped. This permits the ball to be moved fairly rapidly between different configurations, but provides damping for the latter stages of movement to prevent the ball being damaged as it comes into contact with a stop or seat.

It is considered that the damping arrangement has application in devices and apparatus other than ball valves, where variations in damping are required at different stages in the relative movement between two parts.

A fourth aspect of the present invention is characterised by the means for producing rotation of the ball in the event of relative axial movement of the ball and body comprising spigots on the axis of rotation of the ball and slots offset from said axis, ball pivot plates defining axial slots for receiving the respective ball spigots and spigots for location in the respective ball slots, and retaining rings for locating the ends of the plates and thus locating the elements on opposite sides of the ball.

As the ball pivot plates are located by the retaining rings it is not necessary to provide ball cage elements with spacer arms. This leads to a considerable decrease in the manufacturing costs of the ball pivot components.

Preferably, the ball pivot plates and the retaining rings define corresponding flats.

Preferably also, locking means is provided for engaging the ball spigots to lock the spigots in a desired axial position and thus lock the ball, conveniently in the fully open position. The locking means may include an axially extending member such as a sleeve defining slots or apertures to receive the ball spigots. The member preferably includes an arrangement for locking the member in a desired position relative to the body. The arrangement may include a pin engaging a J-slot. The locking means may also be utilised in conjunction with other aspects of the invention, or other forms of ball valve.

Further locking means may provided for locking the first valve open. Where the first valve takes the form of a check valve the locking means may include an axially movable sleeve which may extend through the valve. Most preferably, the locking means for both valves are linked.

Aspects of the invention may include a J-slot and follower arrangement and in accordance with a further aspect of the invention there is provided such an arrangement in which the part defining the J-slot and the part carrying the follower are connected via ratchet means, such that the follower may only advance in a desired direction.

This arrangement is particularly useful in applications where the follower, typically a pin, is of large diameter and may otherwise have a tendency to "fallback" in the slot.

In the above aspects of the invention the means for biassing the ball to the open position may be in the form of a spring. The effective spring force may be varied by selectively pre-compressing the spring. Conveniently this is achieved using spacers of different axial length.

Aspects of the present invention may include apparatus including two relatively movable parts, one part providing mounting for a scraper having a free edge in sliding engagement with the other part, said one part defining an area for receiving material scraped from the surface of the other part.

This arrangement is useful in any application where it is desired to minimise contamination between moving parts. The provision of an area for receiving material scraped from the other part assists in preventing a build-up of material on or adjacent the scraper edge, which would otherwise increase wear of the scraper and might eventually be forced past the scraper.

Aspects of the present invention may include a seal arrangement including a seal mounting and a seal member comprising a sealing portion and an anchoring portion, the sealing member extending through a passage in the mounting which is of smaller dimensions than the anchoring portion.

Preferably the seal member comprises an L-shaped section.

When utilised in valves such as described herein, the seal arrangement is preferable to conventional O-ring seals as the seal member cannot be "washed-out" of its mounting.

Aspects of the present invention may include a slotted sleeve, the slotted end of the sleeve carrying a retaining ring on one side thereof and defining a thread on the other side thereof, the retaining ring stabilising the sleeve end to allow engagement with a corresponding threaded member.

Preferably, the sleeve includes spigots for extending into the slots, to stabilise the sleeve against twisting.

This feature permits slotted sleeves to provide axial connections between threaded parts, with the slots accommodating keys, spring stops and the like.

A further aspect of the invention relates to valve apparatus in which both the first valve and the main valve are flapper valves. When fluid flows through the apparatus in the first direction the main valve member and the main valve sealing surfaces are separated from the flowing fluid by a sleeve which is movable to permit the main valve to close in the event of a tendency for fluid to flow in the second direction and produce a pressure force on the first valve, the first valve being linked to the sleeve.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Reference is first made to FIGS. 1 and 2*a*–2*g* of the drawings which, illustrate a valve in accordance with a first embodiment of the present invention. To facilitate understanding and before describing the valve in detail, the main elements of the valve and the operation of the valve will be briefly described.

Figure 3C:
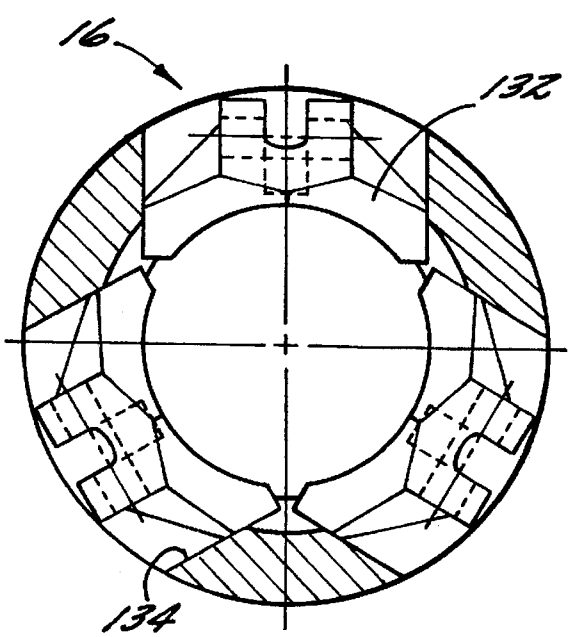
FIGS. 3*a*, 3*b* and 3*c* are enlarged sectional views on line 3—3 of FIG. 2*d*, showing the flappers of a check valve in the normally closed, locked open and normally opened positions, respectively.

As the valve 10 is intended for use in downhole applications, the valve body 12 is elongate and generally cylindrical. The body 12 is hollow, to permit passage of fluid therethrough, and accommodates an axially movable flapper housing 15 which provides location and mounting for a check valve, in the form of a three-leaf flapper valve 16 (see FIGS. 3*a*–3*c*). A main valve, in the form of ball valve 18 is mounted in the body and connected to the flapper housing 15 via a tubular ball pusher 17. The valve 16 is normally closed, while the valve 18 is normally open. The valves 16, 18 are respectively biased to these positions by torsion springs (not shown) mounted on the leaf hinge pins 22, and a compression spring 24, located in an annular chamber 26, which acts on a further ball pusher sleeve 27, the end of which is in contact with the ball 18. Rotation of the ball 18 between the open and closed configurations is achieved by converting axial movement (produced by movement of the ball pusher 17 or the sleeve 27 relative to the body) to rotational movement. Thus, the ball 18 (see FIG. 4*a*) is provided with a pair of spigots 30, 31 on its rotational axis, which locate the ball in respective axial slots 32, in ball pivot plates 33(only one shown) axially fixed relative to the body 12, and slots 34, 35 offset from the axis which engage respective pins 36 of the ball pivot plates 33.

Figure 1:
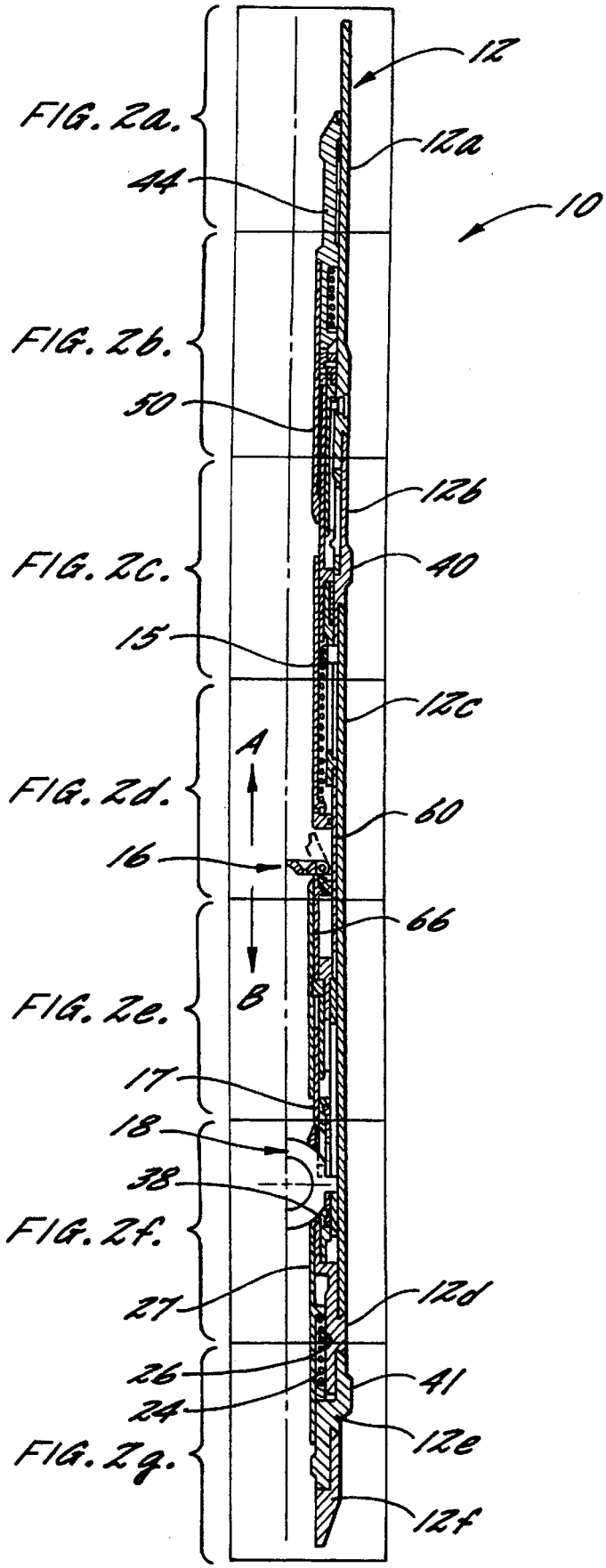
FIG. 1 is a sectional view of one half of a valve apparatus in accordance with a preferred embodiment of the present invention.
Figure 2A:
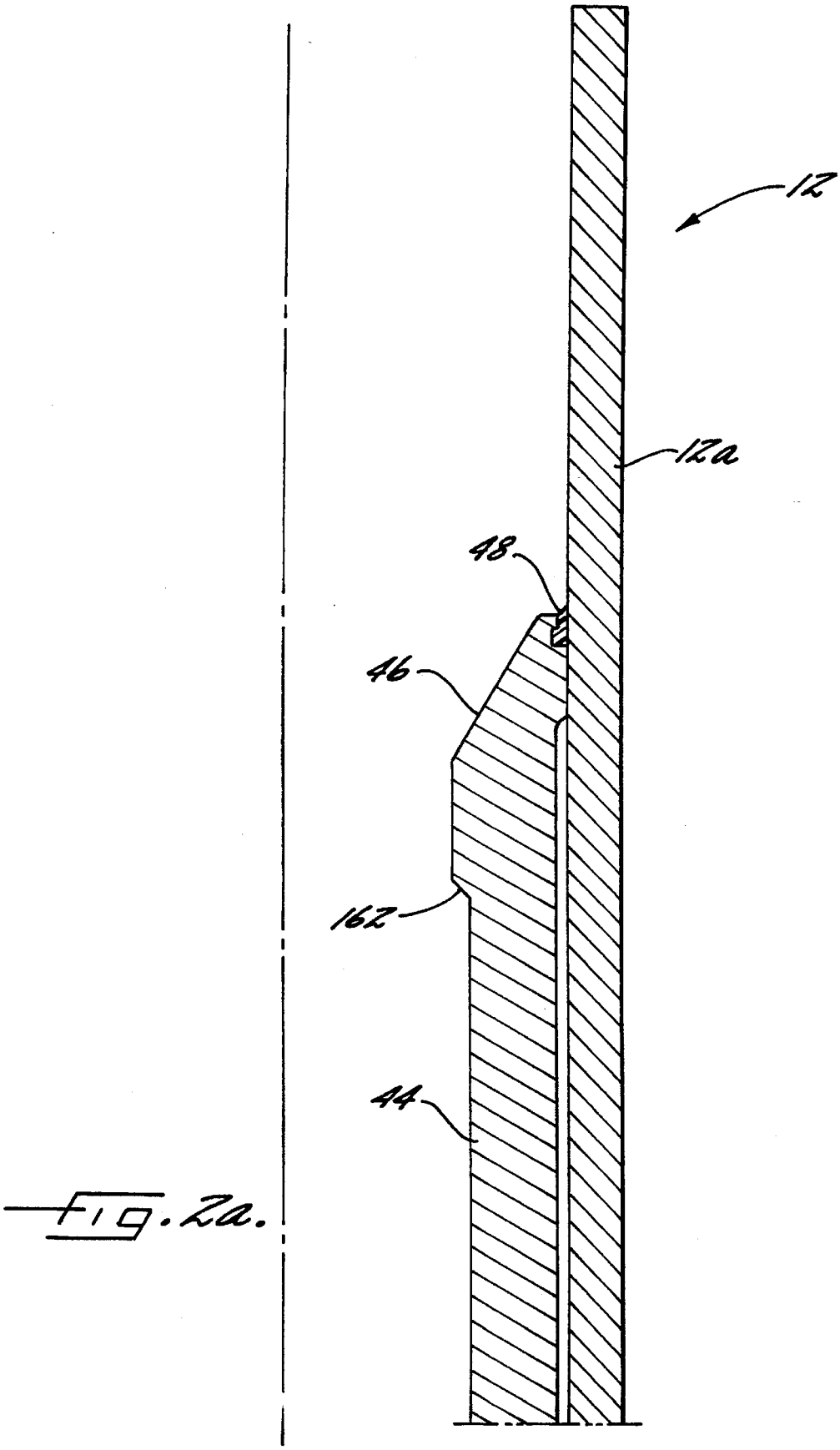
FIGS. 2*a* to 2*g* are enlarged views of the valve apparatus of FIG. 1.
Figure 2B:
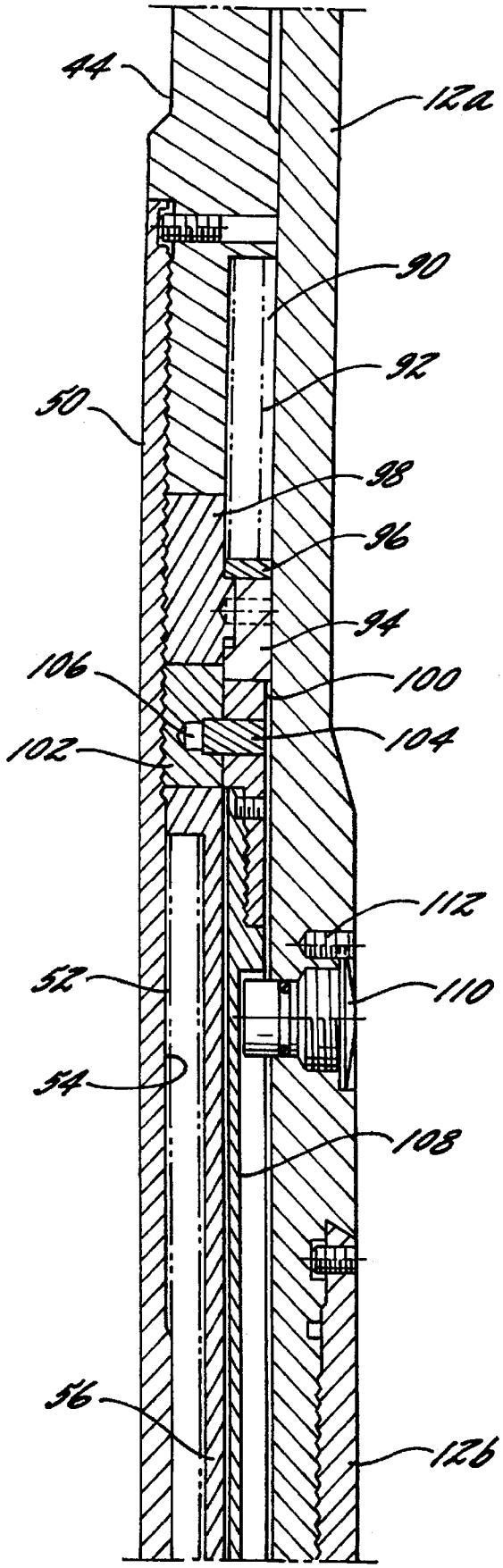
Figure 2C:
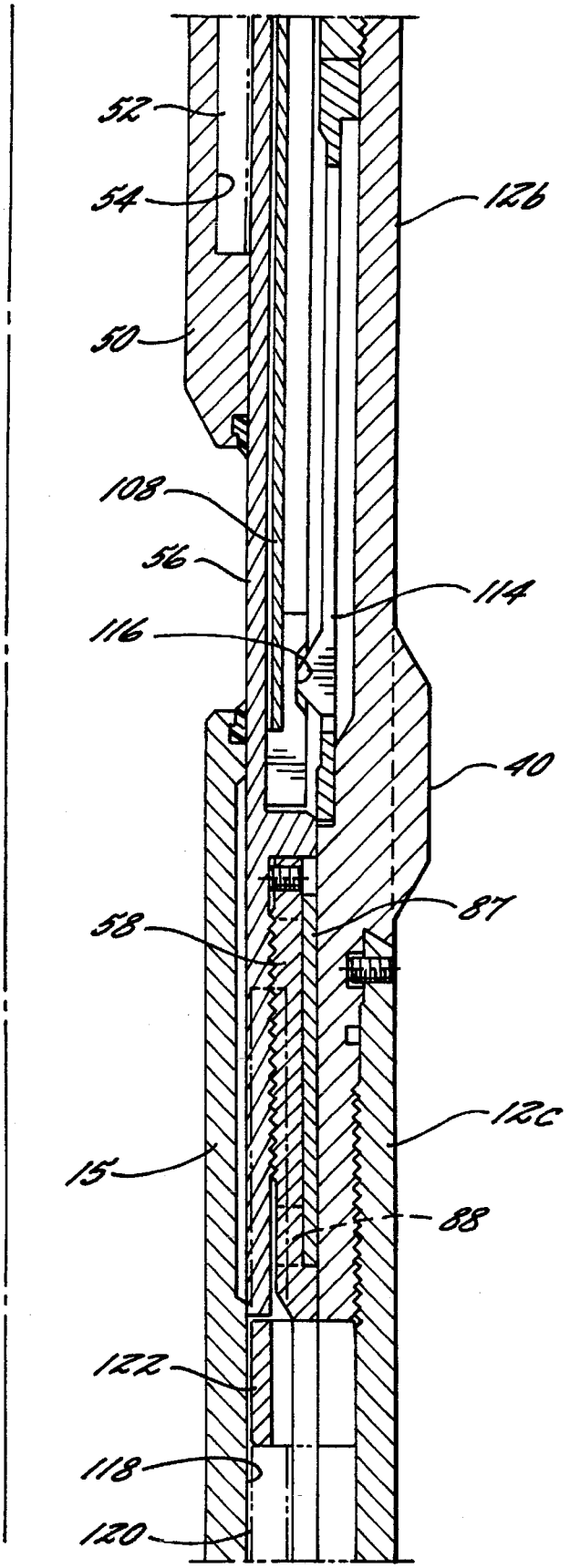
Figure 2D:
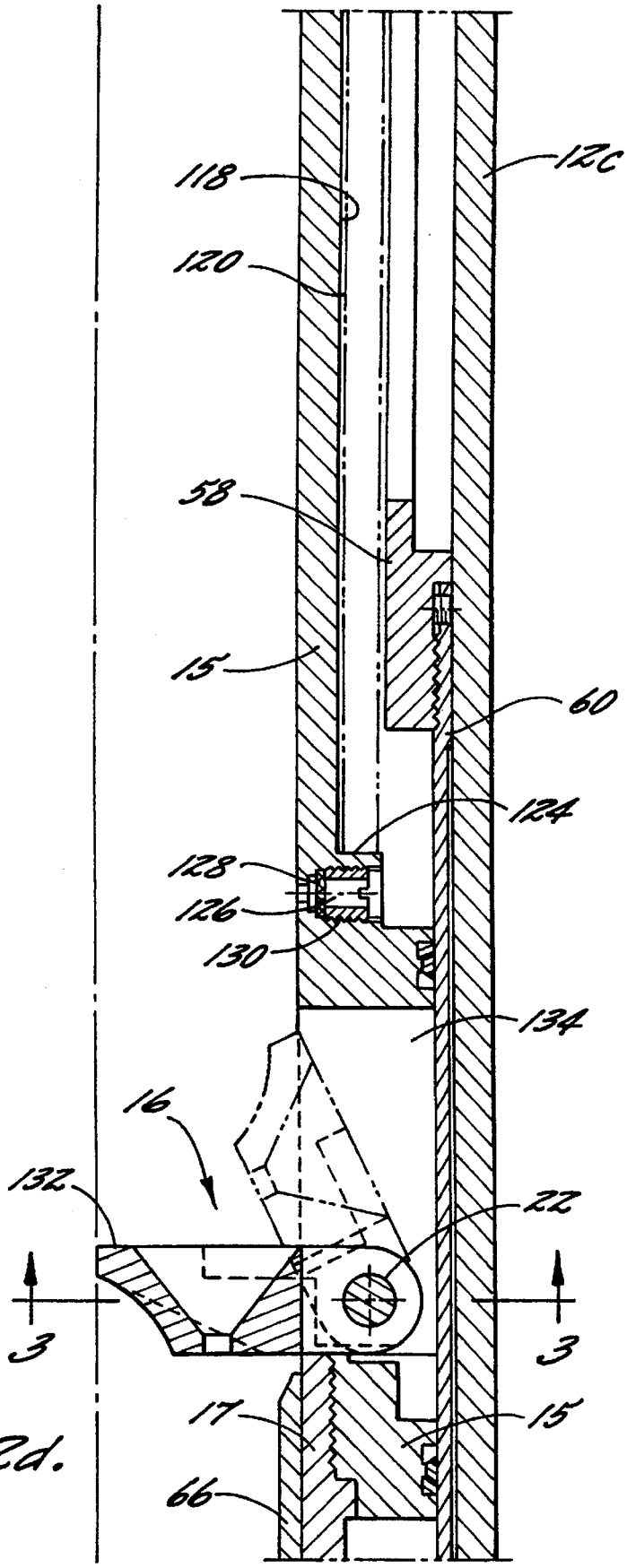
Figure 2E:
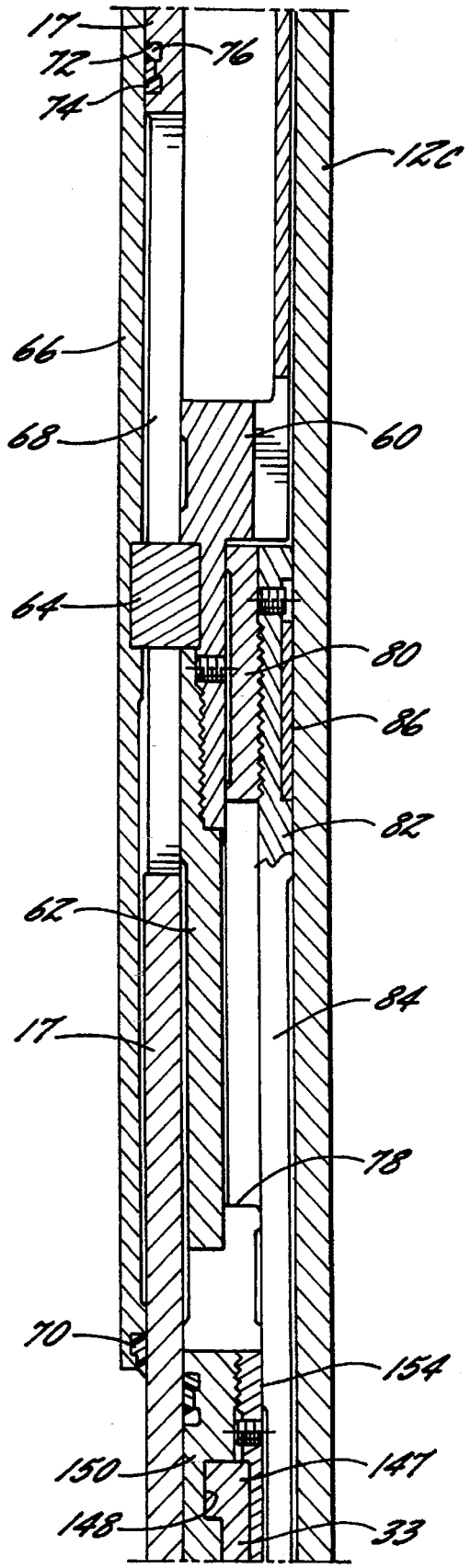
Figure 2F:
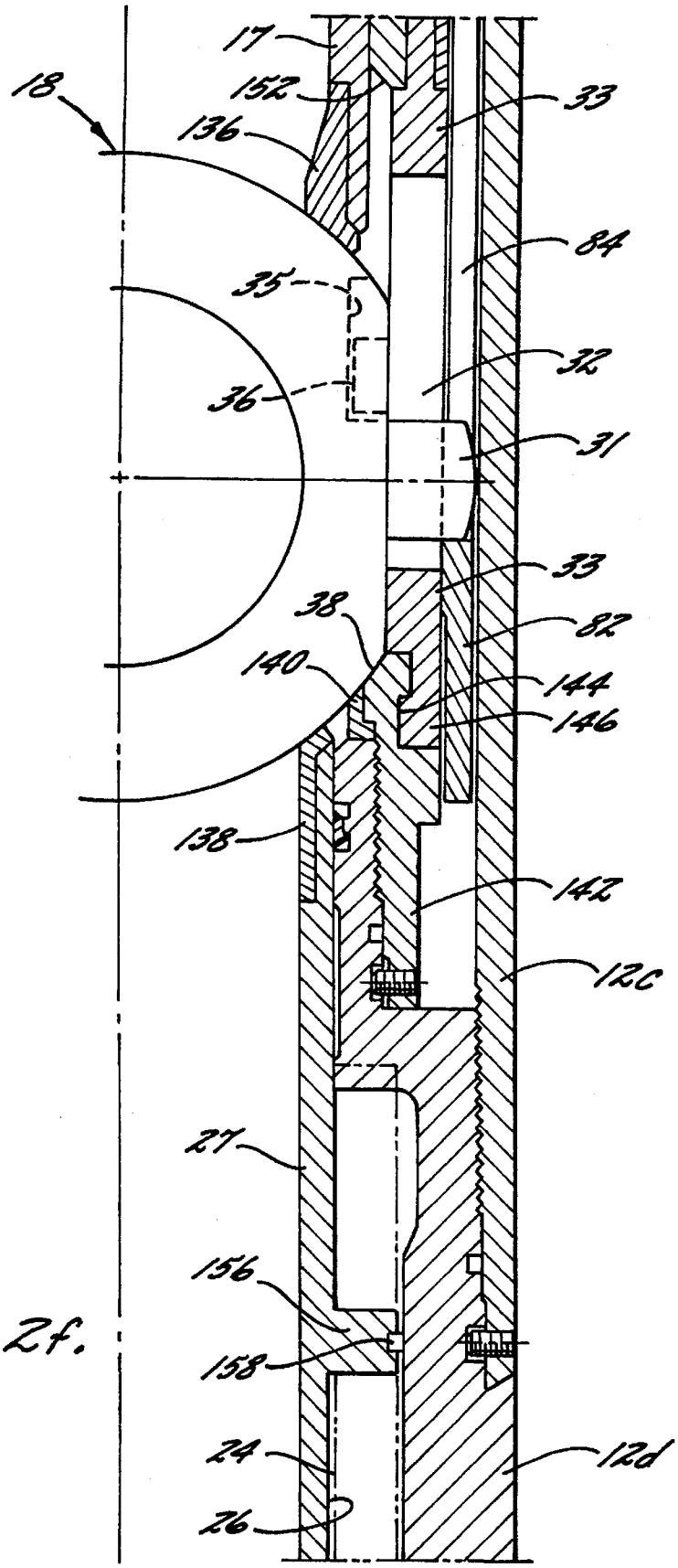
Figure 2G:
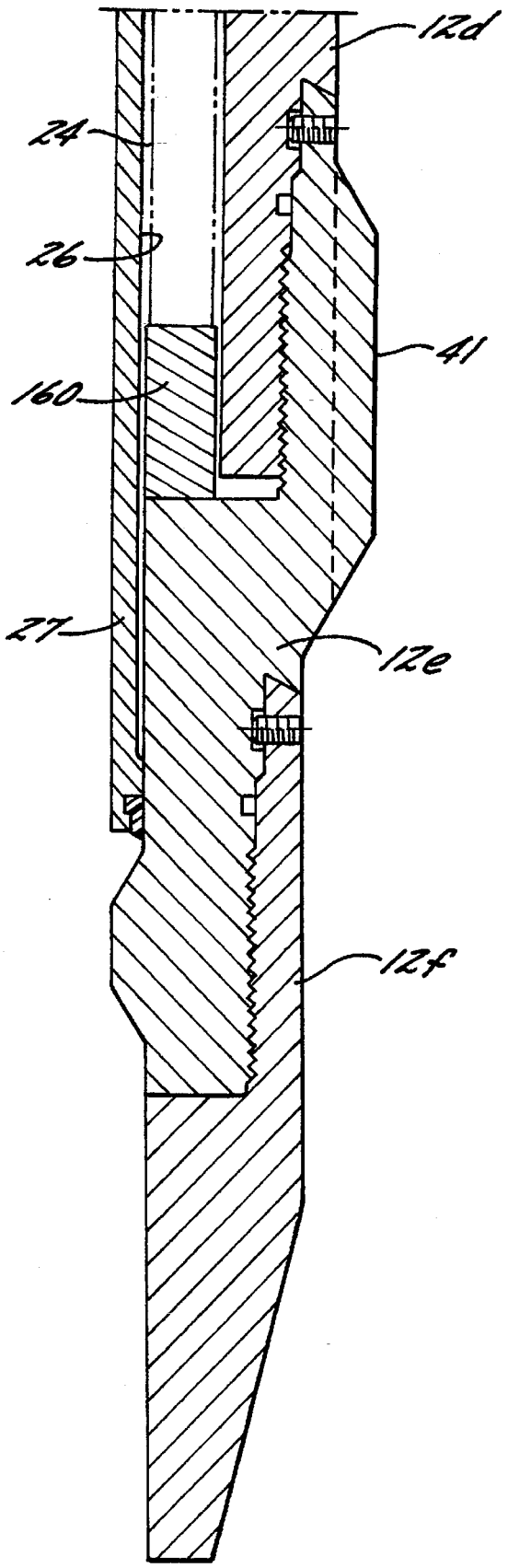

In use, flow in the permitted direction A, pushes the flapper valve 16 open, while the action of the spring 24 maintains the valve 18 open. If there is no flow through the valve 10, the valve 16 closes, but the main valve 18 remains open. If there is a tendency for fluid to flow in the non-permitted direction B, fluid pressure acting on the closed valve 16 pushes the valve 16, valve housing 15 and ball pusher 17 in direction B. This in turn pushes the ball 18 downwardly, against the action of the spring 24, and thus rotates the ball 18 to the closed position (as shown in FIG. 2*f*), where the ball engages a corresponding part-spherical seat 38. This position is maintained until the tendency to flow in direction B ceases.

The valve apparatus 10 will now be described in detail. The valve body 12 is formed of six threaded and pinned tubular parts 12*a* to 12*f*. The upper parts of the body 12*a*, 12*b* accommodate a J-slot arrangement, as will be described, a main central section of the body 12*c* accommodates the valves 16, 18, and lower parts of the body 12*d*, 12*e* provide mounting for ball valve spring 24. Two of the body parts 12*b*, 12*e* carry external centralising lugs 40, 41.

As mentioned above, the body 12 accommodates a J-slot arrangement, and this forms part of a lock-open arrangement, which will be described in due course. A lock open profile sub 44 also forms part of this arrangement and is mounted internally of the body 12 towards the upper end of the apparatus. The sub 44 is normally axially fixed relative to the body, but may be released to allow operation of the lock open arrangement, as will be described. The upper end of the sub 44 is chamfered 46 to provide a lead-in and is also provided with a wiper 48 to minimise contamination between the sub 44 and the body 12. An upper spring transfer sub 50 is pinned and threaded to the sub 44 and provides mounting for a wave spring 52 located within a spring chamber 54. The upper end of the spring 52 supports a lower spring transfer sleeve 56. The lower end of the sleeve 56 is threaded and pinned to an upper slotted sleeve 58 which is itself threaded and pinned to a flapper bypass sleeve 60. A lower load transfer sub 62 is threaded and pinned to the lower end of the sleeve 60 and also serves to locate a transfer key 64 relative to the sleeve 60. The inner end of the key 64 engages a flapper lock open sleeve 66 through an axial slot 68 in the ball pusher 17. A lower end of the sleeve 66 is provided with a wiper 70 for engaging the outer surface of the ball pusher 17, and, adjacent the upper end of the sleeve 66, the ball pusher 17 is provided with a slot 72 which accommodates a wiper 74, leaving a free space 76 above the wiper 74; if the wiper 74 lifts any matter from the outer surface of the sleeve 66 it may collect in the space 76.

The lower load transfer sub 62 is provided with a shoulder 78 which, when the lock open arrangement is being operated, may move upwardly into contact with an upper load transfer sub 80. Threaded and pinned on the outer face of the sub 80 is a lower slotted sleeve 82, the lower ends of the slots 84 receiving the outer ends of the ball spigots 30, 31.

The upper end of the sleeve 82 is stepped inwardly to accommodate a retaining ring 86, which serves the same purpose as a retaining ring 87 provided on the upper slotted sleeve 58; the rings 86, 87 allow the upper ends of the respective sleeves 82, 58, which are in the form of fingers, to carry threads. Further stability against torsion or twisting is provided by providing the rings 86, 87 with spigots 88 for extending into the slots between the sleeve fingers.

Reference is once more made to the lock open profile sub 44. As noted above, the upper spring transfer sub 50 is threaded and pinned to the inner face of the sub 44, while the outer face defines a spring chamber 90 to accommodate a coil spring 92 which acts on an upper ratchet sub or pawl 94, via a bearing washer 96. The pawl 94 is further held in place by a ratchet retaining sub 98 which is threaded to the outer face of the sub 50, directly below the end of the lock open sub 44. The ratchet pawl 94 engages a lower ratchet sub 100 which is keyed to a J retaining sub 102 by a key 104 the inner end of which is located within a annular groove 106 formed in the sub 102. The sub 102 itself is threaded to the inner face of the upper spring transmission sub 50. The lower end of the lower ratchet sub 100 is threaded and pinned (using a left hand thread) to engage J-slot body 108. The J-pin 110 extends through the body **12*a* and is fixed in place by a retaining screw 112. The J-slot body 108 is normally fixed relative to the body 12*a* by a lock open mechanism lock down latch 114 provided on the lower end of the body 12*a* and which engages an annular groove 116 formed on the exterior of the J-slot body 108**.

The flapper housing 15 is mounted internally of the lower spring transfer sleeve 56 and the flapper bypass sleeve 60 and defines a spring chamber 118 which accommodates a coil spring 120. The spring acts between a slotted spring stop 122 which engages the lower end of the body **12*b* and a shoulder 124 on the valve housing 15. Just below the shoulder 124 is a bore fluid equalisation port 126 provided with a sintered disc filter 128 held in place by a retaining screw 130**.

Figure 3B:
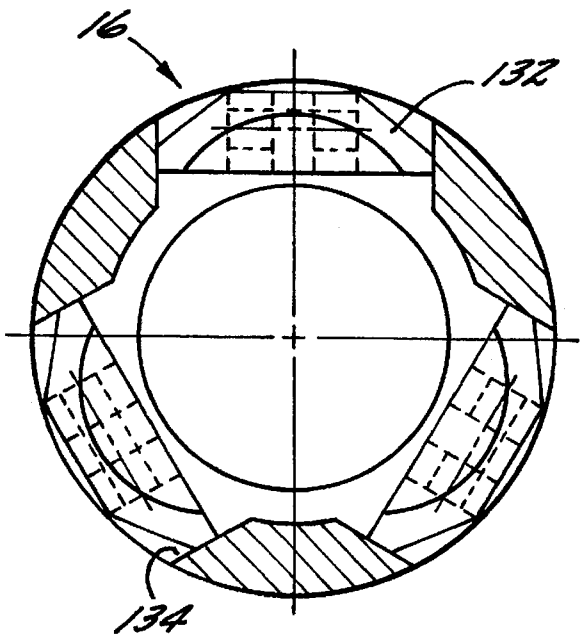
Figure 3A:
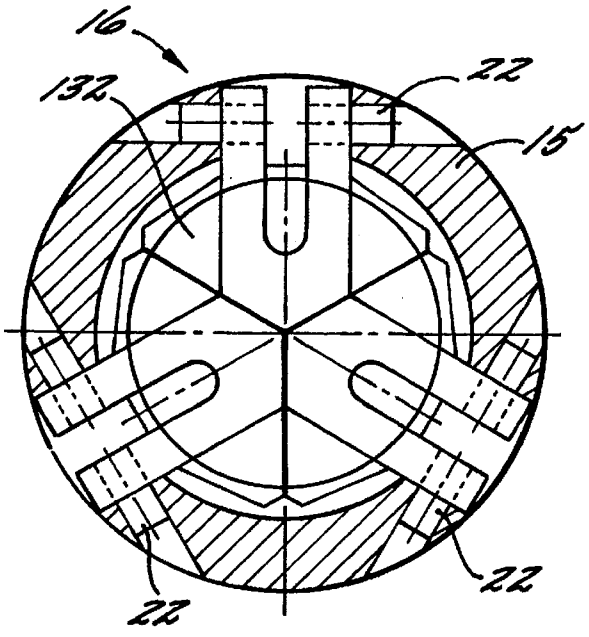
Figure 4A:
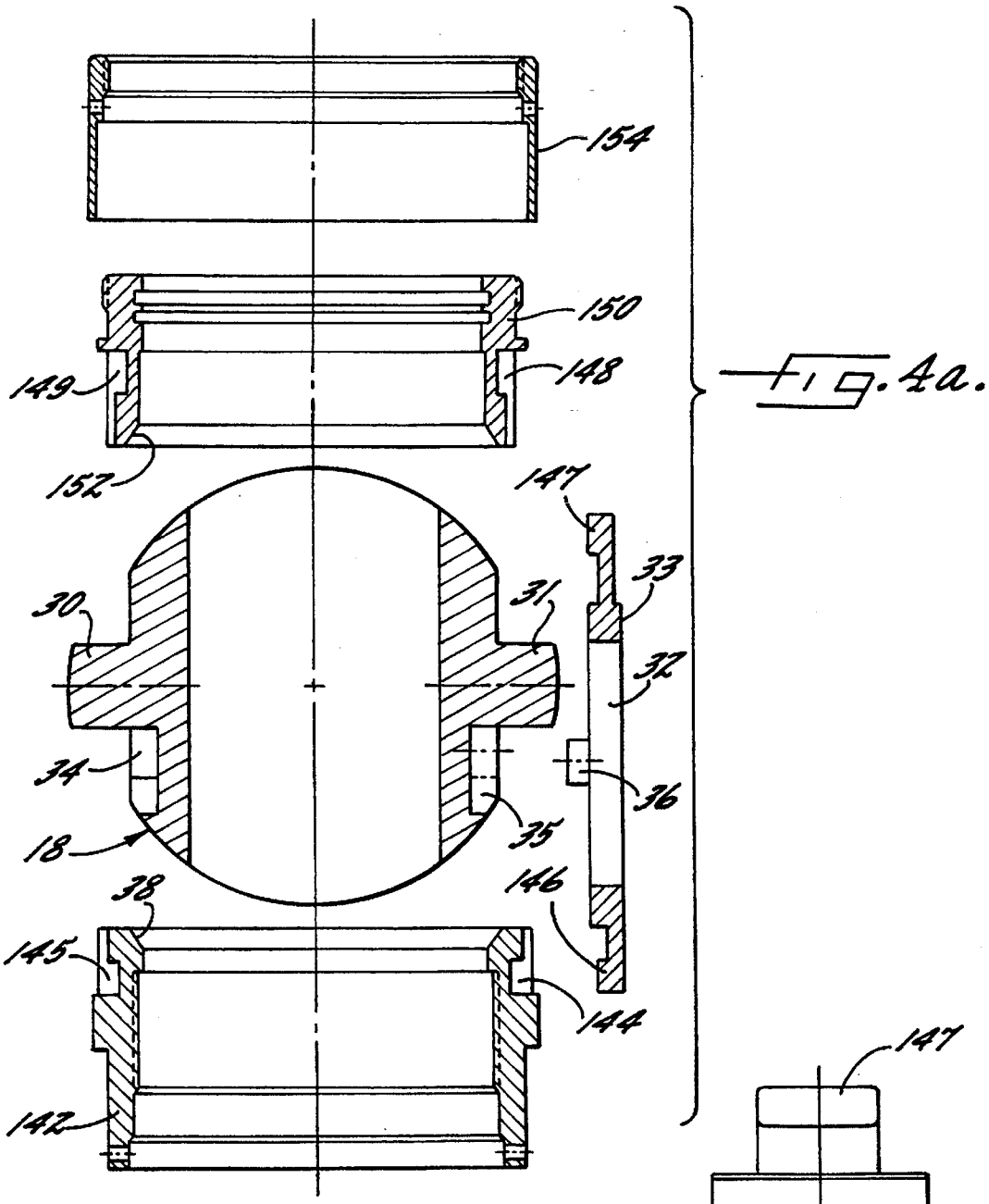
FIG. 4*a* is an exploded sectional view of ball pivot components as illustrated in FIGS. 2*e* and 2*f;*
Figure 4B:
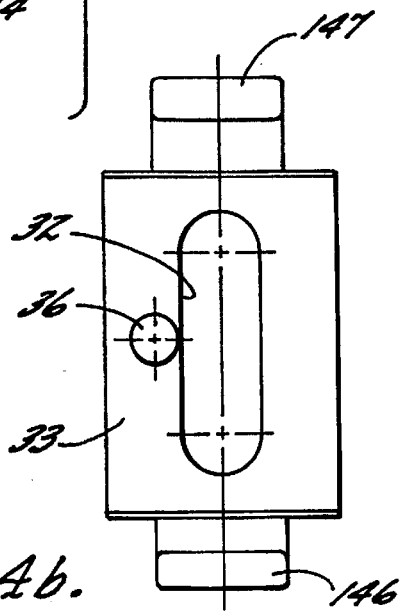
FIG. 4*b* is a view of a ball pivot plate of FIG. 4*a;*
Figures 5A, 5B, 5C:
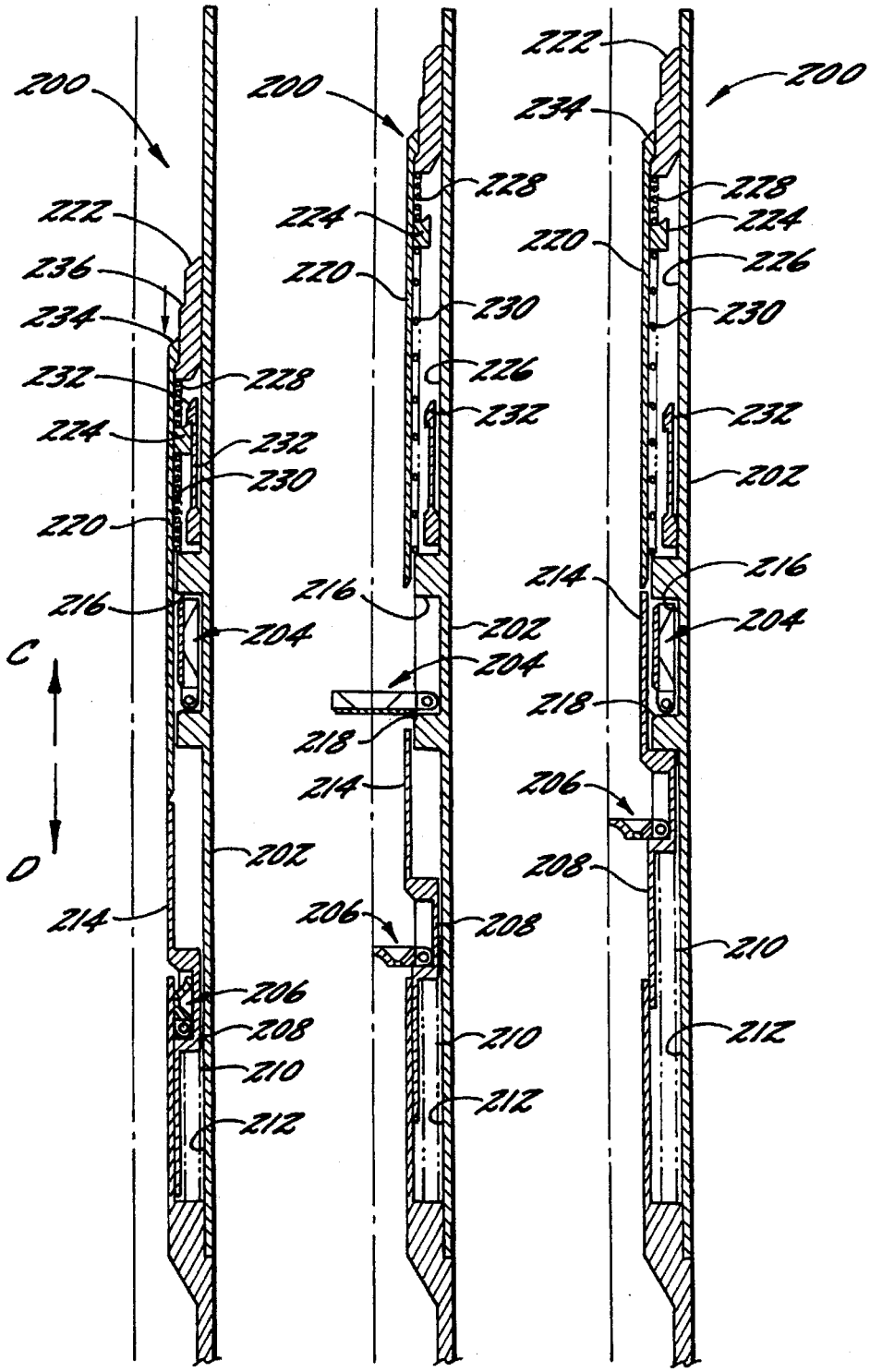
FIGS. 5*a*, 5*b* and 5*c* are sectional views of one half of a dual flapper check valve, in accordance with a further embodiment of the present invention.
Figure 6:
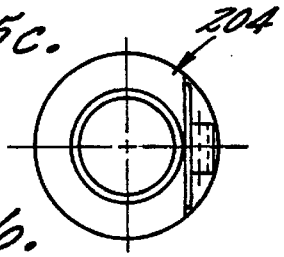
FIG. 6 is a plan view of the main valve of the check valve of FIGS. 5*a* to 5*c*.

The flapper valve 16 comprises three valve flappers 132, which are shown in greater detail in FIGS. **3*a*, 3*b* and 3*c* of the drawings. Each flapper 132 is mounted on a pin 22 itself mounted in the housing 15. The springs (not shown) on the pins 22 normally act to close the flappers, as illustrated in FIG. 3*a*. The flappers 132 may be locked open utilising the flapper lock open sleeve 66, as will be described, and in this position the flappers 132 are wholly located within respective windows 134 formed in the housing 15, as illustrated in FIG. 3*b*. However, during normal operation, with fluid flowing in the direction A, the flow of fluid maintains the flappers 132 in the positions illustrated in FIG. 3*c*, and also as shown in ghost outline in FIG. 2*d*. To minimise the pressure drop across the valve 16, and minimise the creation of turbulence in the fluid, the surfaces of the flappers 132 are profiled such that they match the inner diameter of the flapper housing 15. The flappers 132** may thus ride or "surf" on the fluid flowing through the valve.

As mentioned above, the lower end of the flapper housing 15 is threaded to the ball pusher 17, the lower end of which is provided with a low friction material end piece 136, in contact with the ball 18. Similarly, the lower spring damper sleeve 27 is provided with a low friction end piece 138 for engaging the lower surface of the ball.

As was mentioned above, the ball 18 is mounted in a ball pivot arrangement fixed relative to the body. The body part **12*d* forms a lower ball seal housing, providing a seat for an L-shaped ball seal 140 which is held in place by a ball seal retaining ring 142 which is threaded and pinned to the upper end of the body part 12*d*. The ball seal retaining ring 142 (also shown in FIG. 4*a*) is also provided with flat retaining slots 144, 145 for engaging retaining portions 146 extending from the lower ends of the ball pivot plates. The upper ends of the plates 33 are provided with similar retaining portions 147 for engaging corresponding slots 148, 149 provided in a ring 150 which also defines the upper ball seat 152. The upper ends of the pivot plates 33 are held on the ring 150 by a retaining ring 154 which is threaded and pinned to the upper end of the ring 150**.

If reference is made to FIG. **2*f* it will be noted that the upper end of the spring chamber 26 is of a larger diameter than the lower portion of the chamber and also that the shoulder 156 which provides a upper abutment for the spring 24 is provided with a seal 158 which, in the position as shown in FIG. 2*f*, is in contact with the wall of the spring chamber 24 as defined by the valve body 12*d1***.

With the main valve 18 in its open position, and the shoulder 156 located towards the upper end of the chamber 26, the seal 158 is clear of the chamber wall. Thus, as the ball 18 is pushed down by the ball pusher 17, and the sleeve 27 is pushed downwardly relative to the body 12, fluid in the spring chamber 26 is free to pass around the shoulder 156. Thus, the ball 18 may be moved downwardly relatively rapidly. However, towards the latter part of its travel, the shoulder and seal 156, 158 come into contact with the chamber wall. The seal 158 is slotted such that fluid may still pass over the shoulder 156, at a substantially reduced rate, and this arrangement therefore damps the latter travel of the ball 18, ensuring that the ball 18 does not come into contact with the lower ball seat at a speed which is likely to cause damage to the ball or seat.

The sensitivity of the ball valve 18, that is the fluid pressure in direction B which will cause the valve 18 to close, may be varied by precompressing the spring 24 and this may be easily achieved by providing a spring spacer 160 of predetermined axial length in the lower end of the valve chamber 56.

In use, with fluid flowing in direction A, the valve 16 will be in a configuration as illustrated in FIG. **3*c*, and the ball valve 18 will be in the upper, open position, in contact with the upper ball seat 152**.

If there is no flow, the flappers 132 will close, while the ball 18 remains in the open position.

In the event of flow in the direction B, fluid pressure will act on the upper faces of the closed flappers 132 and will push the flapper housing 15 downwardly relative to the body 12. Thus, the ball pusher 17 will also move downwardly and will push the ball 18 downwardly against the sleeve 27 and the action of the spring 24. As the ball 18 moves downwards relative to the body 12, the pins 36 on the ball pivot plates 33 will cause the ball 18 to rotate about the spigots 30, 31 such that when the ball contacts the lower ball sealing face the ball 18 has been rotated through 90° to the closed position, as illustrated in FIG. *2f*.

If it is desired to lock the valves 16, 18 in the open position, a pulling tool is lowered into the bore to engage with a pulling profile 162 at the upper end of the lock open profile sub 44. Lifting on the sub 44 lifts the J-slot body 108 such that the lock down latch 114 clears the groove 116, permitting relative movement between the sub 44 and its connected parts relative to the body 12. By lifting on the sub 44 it is now thus possible to advance the J-slot body 108 relative to the pin 110 and the body 12, the ratchet arrangement ensuring that the J-slot may only travel in the desired direction.

Lifting the sub 44 thus causes the flapper lock open sleeve 66 to be lifted relative to the body and the flapper housing 15 such that the sleeve 66 passes over the flappers 132 forcing them into the windows 134. After this initial movement the lower load transfer sub 62 comes into contact with the upper load transfer sub 80, allowing the lifting of the lower slotted sleeve 82. This lifts the ball 18, via the spigots 30, 31 to hold the ball 18 in the open position.

To release the valve apparatus 12 from the locked open position it is merely necessary to lift on the profile 44 slightly, advance the J-slot and then lower the profile 44.

Reference is now made to FIGS. *5a*, *5b*, *5c* and 6 of the drawings, which illustrate a dual flapper check valve 200 in accordance with a further aspect of the present invention. The valve 200 is intended to permit fluid flow in direction C, and prevent fluid flow in direction D, and also has the capacity to be locked open. The valve 200 has an elongate cylindrical tubular body 202 which provides mounting for a main flap valve 204. Mounted below the main valve 204 is a smaller multi-leaf flap valve 206, similar to the valve 68 described above. The valve 206 is mounted on a housing 208 which is axially moveable relative to the body 202. A compression spring 210 is located in a spring chamber 212 having a lower abutment defined by the body 202 and an upper abutment defined by the valve housing 208. Thus, the housing 208 and valve 206 are normally biased upwardly, as illustrated in FIG. *5c*. In this position, a sleeve 214 formed on the upper end of the housing holds the main valve 204 open, and encloses the valve within a valve recess 216 defined in the body 202. The sleeve 214 also extends across the main valve seal seat 218. Thus, during normal operation of the valve, with flow in direction C, the sealing surfaces of the main valve 204 and the seat 218 are protected from the fluid by the sleeve 214.

In the event of a tendency for fluid to flow in direction D, the fluid pressure force acting on the valve 206 pushes the valve housing 208 downwardly, allowing the main valve 204 to close (FIG. *5b*).

As with the valve apparatus 10 described above, this valve apparatus 200 may be locked open, as illustrated in FIG. *5a*. The arrangement includes a lock open sleeve 220 which depends from a release profile 222 mounted internally of the upper end of the body 202. Mounted on the outer face of the sleeve 220 is lock open latch profile 224. The profile 224 extends into a chamber 226 defined by the body 202, and accommodating a small spring 228 and a large spring 230 located above and below the profile 224, respectively. Located in a lower portion of the chamber 226 is a lock open latch 232.

To lock the valve 200 open, a tool is run into the valve to engage a first no-go 234 defined by the upper end of the sleeve 220. As the lower end of the sleeve 220 is initially in contact with the upper end of the sleeve 214, as shown in FIG. *5c*, downward movement of the sleeve 220 relative to the body 202 pushes the sleeve 214 and the housing 208 downwardly. As the housing 208 moves downwardly, the main valve 204 is retained in the open position by the sleeve 220 and the flapper valve 206 is then pushed open by the upper end of the body sleeve defining the spring chamber 212. Reaching the lowermost position of the sleeve 220, as shown in FIG. *5a*, both valves are held open, and the lock open latch profile 224 engages the look open latch 232.

To release the sleeve 220, a tool is run into the valve 200 and engages a second no-go 236 defined by the release profile 222. The profile 222 is moved downwardly until the lower end of the profile engages the lock open latch 232 which is then forced outwardly to release the lock open latch profile 224, allowing the spring 230 to lift the sleeve 220 and allow the valve to operate as normal.

I claim:

1. Valve apparatus for permitting flow in a first direction and preventing flow in a second direction, the apparatus comprising a body defining a through bore, a normally closed first valve and a normally open second valve, and a sleeve operatively associated with the first valve, the sleeve being axially moveable from a first position, in which the sleeve isolates the second valve from fluid flowing through the body bore in said first direction, and a second position, which permits the second valve to close to prevent flow of fluid through the body in said second direction.

2. The apparatus of claim 1, wherein the second valve is a flapper valve.

3. The apparatus of claim 1, wherein the first valve is a flapper valve comprising a plurality of valve members, the surfaces of the valve members being profiled to conform with the bore profile when the valve members are in the open position such that the valve members will ride or surf on the fluid flowing through the body in said first direction.

4. The apparatus of claim 1, wherein the body defines a seat for the second valve and the seat is isolated from the fluid flowing through the body in said first direction by the sleeve in the first position.

5. The apparatus of claim 1, including means for biassing the sleeve towards the first position.

6. The apparatus of claim 1, wherein the first valve is mounted on the sleeve.

7. The apparatus of claim 6, including first and second lock open sleeves, the second lock open sleeve being axially movably mounted on the body from a retracted position to a lock open configuration, in moving from the retracted position to the lock open position the second lock open sleeve acting on the first sleeve to move the first sleeve to a position in which the first valve is held open by the second lock open sleeve, and in the lock open position the first lock open sleeve holding the second valve open.

8. The apparatus of claim 7, including means for locking the second lock open sleeve in the lock open configuration.

9. The apparatus of claim 8, wherein the locking means is releasable.

10. Valve apparatus for permitting flow in a first direction and preventing flow in a second direction, the apparatus comprising a body defining a through bore, a normally closed first flapper valve mounted on a sleeve within the body, and a normally open second valve being mounted on the body with the body defining a seat for the second valve, the sleeve being axially moveable from a first position, in which the sleeve isolates the second valve and the valve seat from fluid flowing through the body bore in said first direction, and a second position which permits the second valve to close to prevent flow of fluid through the body in said second direction.

* * * * *